US007396424B2

(12) United States Patent
Ogasa

(10) Patent No.: US 7,396,424 B2
(45) Date of Patent: Jul. 8, 2008

(54) METHOD OF MANUFACTURING A HARD PRECIOUS METAL ALLOY MEMBER

(76) Inventor: Kazuo Ogasa, 1958-229, Nakano, Tsukuichou, Tsukui-gun, Kanagawa 220-0207 (JP)

( * ) Notice: Subject to any disclaimer, the term of this patent is extended or adjusted under 35 U.S.C. 154(b) by 507 days.

(21) Appl. No.: 11/131,090

(22) Filed: May 16, 2005

(65) Prior Publication Data

US 2005/0205173 A1 Sep. 22, 2005

Related U.S. Application Data

(60) Division of application No. 10/090,282, filed on Mar. 4, 2002, now Pat. No. 6,913,657, which is a continuation of application No. PCT/JP00/04411, filed on Jul. 3, 2000.

(51) Int. Cl.
*C22C 1/14* (2006.01)

(52) U.S. Cl. ..... 148/678; 148/430; 420/501

(58) Field of Classification Search ..... None
See application file for complete search history.

(56) References Cited

U.S. PATENT DOCUMENTS

| | | | |
|---|---|---|---|
| 5,071,619 | A | 12/1991 | Hosoda et al. |
| 5,171,643 | A | 12/1992 | Suzuki et al. |
| 5,518,691 | A | 5/1996 | Muragishi et al. |
| 6,063,213 | A | 5/2000 | Ogasa |
| 6,123,786 | A | 9/2000 | Uchiyama et al. |
| 6,913,657 | B2 * | 7/2005 | Ogasa ..... 148/442 |

FOREIGN PATENT DOCUMENTS

| | | | |
|---|---|---|---|
| EP | 0 685 565 | A1 | 12/1995 |
| EP | 0 819 773 | A1 | 1/1998 |
| EP | 0 882 805 | A1 | 12/1998 |
| EP | 0 922 780 | A1 | 6/1999 |
| GB | 2 116 208 | A | 9/1983 |
| JP | 51-55724 | A | 5/1976 |
| JP | 63-020426 | A | 1/1988 |
| JP | 63-57753 | A | 3/1988 |
| JP | 03-188232 | A | 8/1991 |
| JP | 07-070670 | A | 3/1995 |
| JP | 07-070671 | A | 3/1995 |

(Continued)

OTHER PUBLICATIONS

Chemical Abstracts, 124:63442, vol. 124, No. 6 (1996) of Ning, Y.T. et al., "Influence of rare-earth elements on mechanical properties of palladium," *Report*, (1994), Institute Precious Metals, Kumming, Peop. Rep. China.

(Continued)

*Primary Examiner*—John P. Sheehan
(74) *Attorney, Agent, or Firm*—Frishauf, Holtz, Goodman & Chick, P.C.

(57) ABSTRACT

A method of manufacturing a hard precious metal alloy member comprising casting a material consisting essentially of a gold alloy, which has a gold content of from 37.50 to 98.45 wt %, and contains gadolinium in an amount of not less than 50 ppm, but less than 1,5000 ppm; subjecting the material to a solution heat treatment; and subjecting the material to an aging treatment after the solution heat treatment.

10 Claims, 3 Drawing Sheets

FOREIGN PATENT DOCUMENTS

| | | | |
|---|---|---|---|
| JP | 07-207384 | A | 8/1995 |
| JP | 8-31253 | A | 2/1996 |
| JP | 11-126788 | A | 5/1999 |
| JP | 2000-034529 | A | 2/2000 |
| SE | 8002785 | A | 10/1981 |

OTHER PUBLICATIONS

"Nonferrous Material," vol. 5, pp. 56-57, Sep. 18, 1987, The Japan Institute of Metals.
K.A. Gscheidner, Jr. et al., "Binary Alloy Phase Diagrams," 2nd Ed., vol. 1, pp. 371-373.

* cited by examiner

METHOD OF MANUFACTURING A HARD PRECIOUS METAL ALLOY MEMBER

CROSS-REFERENCES TO RELATED APPLICATIONS

This application is a divisional application of application Ser. No. 10/090,282 filed Mar. 4, 2002, now U.S. Pat. No. 6,913,657; which is a continuation application of International Application PCT/JP00/04411 filed Jul. 3, 2000.

BACKGROUND OF THE INVENTION

1. Field of the Invention

The present invention relates to a hard precious metal alloy member suitable for a decorative member, a dental member, an electronic member, etc., and a method of manufacturing the same.

2. Background Art

Conventionally, gold (Au), silver (Ag), platinum (Pt), palladium (Pd), rhodium (Rh), iridium (Ir), ruthenium (Ru), osmium (Os), etc. are known as precious metal materials, and are used in various fields, such as decorative members, dental members, electronic members, etc.

However, where these precious metal materials are used in such fields, they are not necessarily satisfactory in mechanical properties, such as hardness, Young's modulus, etc., and durability properties, such as corrosion resistance etc. Besides, there is another problem in that their operability is poor.

On the other hand, in recent years, white gold (Ni—Cu—Au alloy) has attracted attention in the field of ornamental articles, but its hardness has not yet been satisfactory. In addition, the alloy has a poor color tone, and an unsatisfactory corrosion resistance, thereby hardly maintaining aesthetic value. For this reason, the alloy is commercialized by using a plating treatment etc. under the present circumstances. Furthermore, the alloy cannot help having its hardness lowered by a heat treatment, such as brazing etc. Besides, its operability is also poor.

DISCLOSURE OF INVENTION

The present invention has been made in light of the problems described above, and an object of the present invention is to provide a hard precious metal alloy member having excellent mechanical properties, and a method of manufacturing the same.

Another object of the present invention is to provide a hard precious metal alloy member having an excellent corrosion resistance, in addition to the excellent mechanical properties, and a method of manufacturing the same.

Still another object of the present invention is to provide a hard precious metal alloy member having a satisfactory color tone, in addition to the above described properties, and a method of manufacturing the same.

Still another object of the present invention is to provide a hard precious metal alloy member having a satisfactory operability, in addition to the above described properties, and a method of manufacturing the same.

According to an aspect of the present invention, there is provided a hard precious metal alloy member constituted of a gold alloy, which has a gold Au content of from 37.50 to 98.45 wt %, i.e., weight %, and contains gadolinium Gd in a range of not less than 50 ppm but less than 15,000 ppm.

According to another aspect of the present invention, there is provided a hard precious metal alloy member constituted of a gold alloy, which has a gold Au content of from 37.50 to 98.45 wt %, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total.

According to still another aspect of the present invention, there is provided a hard precious metal alloy member constituted of a platinum alloy, which has a platinum Pt content of not less than 85.0 wt %, and contains gadolinium Gd in a range of not less than 50 ppm but less than 15,000 ppm.

According to still another aspect of the present invention, there is provided a hard precious metal alloy member constituted of a platinum alloy, which has a platinum Pt content of not less than 85.0 wt %, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total.

According to still another aspect of the present invention, there is provided a hard precious metal alloy member constituted of a silver alloy, which has a silver Ag content of not less than 80.0 wt %, and contains gadolinium Gd in a range of not less than 50 ppm but less than 15,000 ppm.

According to still another aspect of the present invention, there is provided a hard precious metal alloy member constituted of a silver alloy, which has a silver Ag content of not less than 80.0 wt %, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total.

According to still another aspect of the present invention, there is provided a hard precious metal alloy member formed of a precious metal alloy, which is constituted of two or more elements selected from the precious metal element group consisting of gold Au, silver Ag, platinum Pt, palladium Pd, rhodium Rh, ruthenium Ru, and osmium Os, and contains gadolinium Gd in a range of not less than 50 ppm but less than 15,000 ppm.

According to still another aspect of the present invention, there is provided a hard precious metal alloy member formed of a precious metal alloy, which is constituted of two or more elements selected from the precious metal element group consisting of gold Au, silver Ag, platinum Pt, palladium Pd, rhodium Rh, ruthenium Ru, and osmium Os, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total.

According to still another aspect of the present invention, there is provided a hard precious metal alloy member formed of a precious metal alloy, which is constituted of at least one element selected from the group consisting of gold Au, silver Ag, platinum Pt, palladium Pd, rhodium Rh, ruthenium Ru, and osmium Os, and at least one element selected from the group consisting of copper Cu, nickel Ni, aluminum Al, zinc Zn, and Fe, and contains gadolinium Gd in a range of not less than 50 ppm but less than 15,000 ppm.

According to still another aspect of the present invention, there is provided a hard precious metal alloy member formed of a precious metal alloy, which is constituted of at least one element selected from the group consisting of gold Au, silver Ag, platinum Pt, palladium Pd, rhodium Rh, ruthenium Ru, and osmium Os, and at least one element selected from the group consisting of copper Cu, nickel Ni, aluminum Al, zinc Zn, and Fe, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total.

According to still another aspect of the present invention, there is provided a hard precious metal alloy member constituted of a platinum alloy, which has a platinum Pt content of not less than 99.45 wt %, and contains gadolinium Gd in a range of not less than 50 ppm but less than 5,000 ppm.

According to still another aspect of the present invention, there is provided a hard precious metal alloy member constituted of a platinum alloy, which has a platinum Pt content of not less than 99.45 wt %, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total.

According to still another aspect of the present invention, there is provided a hard precious metal alloy member constituted of a palladium alloy, which has a palladium Pd content of not less than 99.45 wt %, and contains gadolinium Gd in a range of not less than 50 ppm but less than 5,000 ppm.

According to still another aspect of the present invention, there is provided a hard precious metal alloy member constituted of a palladium alloy, which has a palladium Pd content of not less than 99.45 wt %, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total.

According to still another aspect of the present invention, there is provided a hard precious metal alloy member constituted of a silver alloy, which has a silver Ag content of not less than 99.45 wt %, and contains gadolinium Gd in a range of not less than 50 ppm but less than 5,000 ppm.

According to still another aspect of the present invention, there is provided a hard precious metal alloy member constituted of a silver alloy, which has a silver Ag content of not less than 99.45 wt %, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total.

In the case of the precious metal member constituted of a gold alloy, which has a gold Au content of from 37.50 to 98.45 wt %, where the member is constituted of a cast alloy, it can have a hardness of not less than 150 Hv, and a Young's modulus of 6,000 kg/mm$^2$, and where the member is constituted of a worked alloy at a working rate of not less than 50%, it can have a hardness of not less than 180 Hv, and a Young's modulus of 6,000 kg/mm$^2$.

In the case of the precious metal member constituted of a platinum alloy, where the member is constituted of a cast alloy, it can have a hardness of not less than 120 Hv, and a Young's modulus of 8,000 kg/mm$^2$, and where the member is constituted of a worked alloy at a working rate of not less than 50%, it can have a hardness of not less than 150 Hv, and a Young's modulus of 8,000 kg/mm$^2$. In the case of the precious metal member constituted of another alloy, where the member is constituted of a cast alloy, it can have a hardness of not less than 130 Hv, and a Young's modulus of 7,000 kg/mm$^2$, and where the member is constituted of a worked alloy at a working rate of not less than 50%, it can have a hardness of not less than 150 Hv, and a Young's modulus of 7,000 kg/mm$^2$. In the case of the member constituted of an Ag or Pd alloy of not less than 99.45 wt %, where the member is constituted of a cast alloy, it can have a hardness of not less than 120 Hv, and a Young's modulus of 7,000 kg/mm$^2$, and where the member is constituted of a worked alloy at a working rate of not less than 50%, it can have a hardness of not less than 140 Hv, and a Young's modulus of 7,000 kg/mm$^2$.

According to still another aspect of the present invention, there is provided a method of manufacturing a hard precious metal alloy member, comprising the steps of: casting a material having any one of the compositions described above; subjecting the material to a solution heat treatment; and subjecting the material to an aging treatment after the solution heat treatment.

According to still another aspect of the present invention, there is provided a method of manufacturing a hard precious metal alloy member, comprising the steps of: casting a material having any one of the compositions described above; subjecting the material to a solution heat treatment; working the material into a predetermined shape; and subjecting the material to an aging treatment before or after the working.

In these methods, the solution heat treatment and the aging treatment are performed at temperatures of from 600 to 2,500° C., and of from 150 to 600° C., respectively. Note that, the temperature of the solution heat treatment is appropriately set in accordance with the alloy composition, because alloys have melting points different from each other.

According to still another aspect of the present invention, there is provided a hard precious metal alloy member constituted of a gold alloy, which has a gold Au content of not less than 99.45 wt %, and contains gadolinium Gd in a range of not less than 50 ppm but less than 5,000 ppm, wherein the member has a hardness of not less than 150 Hv, and a Young's modulus of 5,000 kg/mm$^2$.

According to still another aspect of the present invention, there is provided a hard precious metal alloy member constituted of a gold alloy, which has a gold Au content of not less than 99.45 wt %, and contains gadolinium Gd and at least one element selected from the group consisting of rare-earth elements other than Gd, alkaline-earth elements, silicon Si, aluminum Al, and boron B, in a range of not less than 50 ppm but less than 15,000 ppm in total, wherein the member has a hardness of not less than 130 Hv, and a Young's modulus of 5,000 kg/mm$^2$.

Throughout this specification, the term "constituted of" means "consisting essentially of" and "is constituted of" means "consists essentially of".

DETAILED DESCRIPTION OF THE INVENTION

Figure 1:
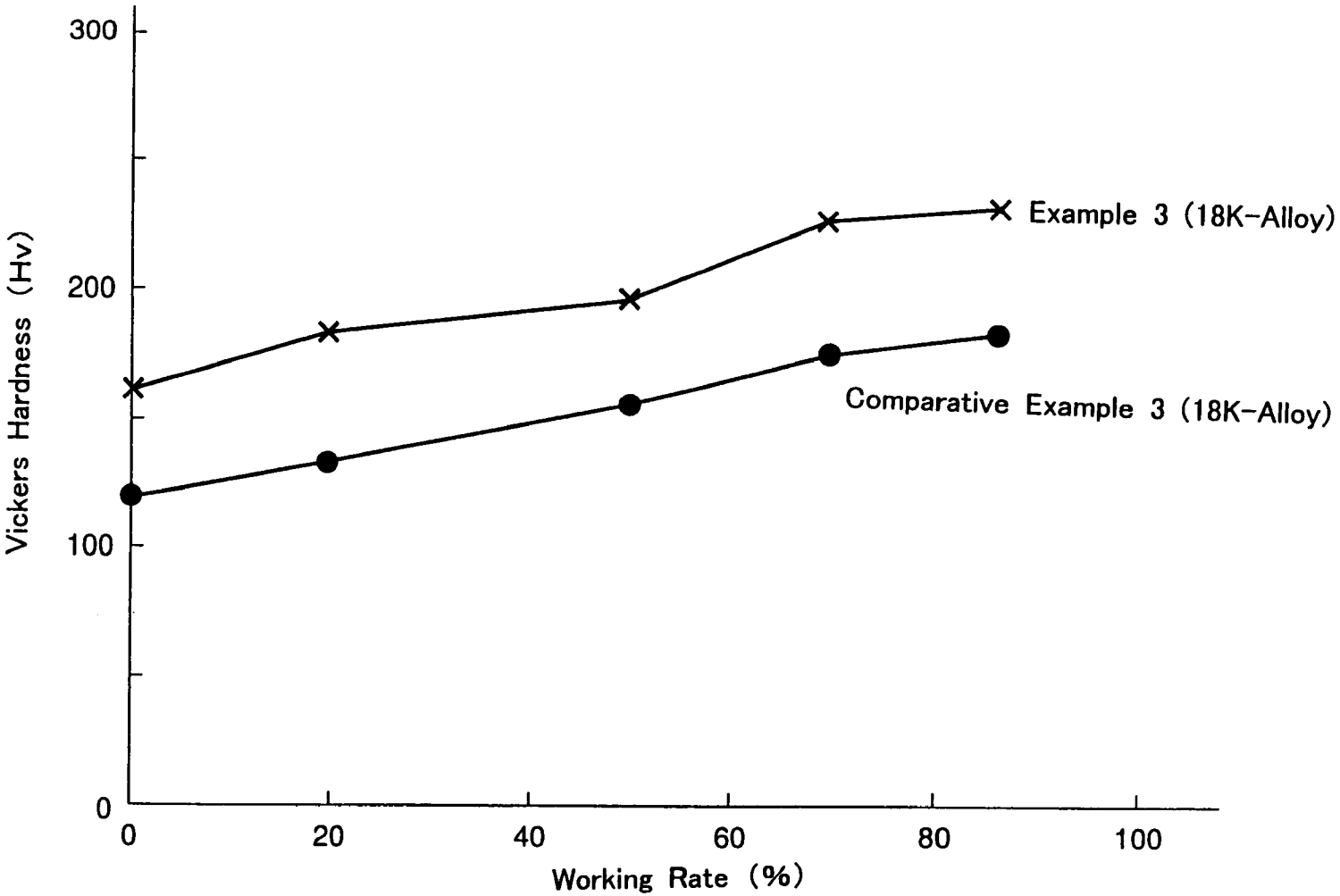
FIG. 1 is a view showing relationships between the working rate and the hardness in gold alloys corresponding to 18K-gold.

The present invention will be described in detail hereinafter.

A hard precious metal alloy member according to a first embodiment of the present invention is constituted of a gold alloy, which has a gold Au content of from 37.50 to 98.45 wt %, i.e., weight %, and contains a hardening additive in a range of not less than 50 ppm but less than 15,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B.

As described above, where the gold Au content is set to be from 37.50 to 98.45 wt %, and the hardening additive, which is constituted of gadolinium Gd only, or a combination thereof with another element, is added in an appropriate amount, even a cast alloy without any work can have a high hardness of not less than 130 Hv, and a high Young's modulus of 6,000 kg/mm$^2$ which has never been obtained.

Gd is the most effective hardening element in consideration of volume occupation rate etc., and is also highly effective in improving heat-resistance. Particularly, it has been found that, where Gd is added, a very high Young's modulus can be obtained. Since Gd is greatly effective in improving hardness and Young's modulus, it is required to be added in a small amount, so that the color tone of the based alloy is prevented from changing, thereby obtaining a satisfactory color tone.

Although the effect of the hardening additive is provided even where only Gd is used, a more excellent effect can be obtained by means of synergy where Gd is added in combination with at least one element selected from the group consisting of rare-earth elements other than Gd, alkaline-earth elements, silicon Si, aluminum Al, and boron B.

Ca is preferably selected from the alkaline-earth elements. Where gadolinium Gd and silicon Si are used for the hardening additive, the amount of Gd is preferably set to be not more than 50 wt % of the total amount of Gd and Si. Where gadolinium Gd and aluminum Al are used, the amount of Gd is preferably set to be not less than 10 wt % of the total amount of Gd and Al.

The amount of hardening additive is set to fall in a range of not less than 50 ppm but less than 15,000 ppm, because the hardening effect is not effectively provided where the amount is less than 50 ppm, while it is difficult to maintain the characteristics of Au where the amount is not less than 15,000 ppm.

In this case, an objective gold alloy is not limited to a specific alloy, but may be an ordinary alloy, so long as it has a gold Au content of from 37.50 to 98.45 wt %, i.e., a gold quality of 9K (karat) or more. For example, an alloy of Au containing at least one of Pt, Pd, and Ag may be used as the objective alloy. An example of 18K-alloy is an alloy of 75%-Au containing Pt and Pd, or containing Ag and Pd. An example of 9K-alloy is an alloy of 38%-Au containing Ag, Pt, and Pd. These alloys particularly exhibit a satisfactory corrosion resistance, because they do not basically contain, as an alloy component, an element, such as Cu etc., whose corrosion resistance is low to some extent. However, another gold alloy, such as white gold (Ni—Cu—Au alloy) etc., containing an alloy element other than precious metals may be used. Components contained other than the hardening additive are also not limited, so long as they are ones generally used for gold alloys. In other words, the hardening additive described above is effective to any existing gold alloy.

An explanation will be given of a method of manufacturing an alloy member having properties described above.

In the case of a cast alloy, an alloy material having a composition as described above is cast, then is subjected to a solution heat treatment in which it is heated to a predetermined temperature and then quickly cooled, and then is subjected to an aging treatment.

In the case of a worked alloy, an alloy material having a composition as described above is cast, then is subjected to a solution heat treatment in which it is heated to a predetermined temperature and then quickly cooled, and then is worked into a predetermined shape, wherein the material is subjected to an aging treatment before or after being worked.

In these cases, the solution heat treatment may be performed at a temperature of from 600 to 2,500° C., while the aging treatment may be performed at a temperature of from 150 to 600° C., though the temperatures for the solution heat treatment and the aging treatment vary depending on the type of the alloy.

Upon performing the solution heat treatment and the aging treatment, the alloy is remarkably hardened by an action mainly of Gd, and synergy of Gd with another added element. As a result, even in the case of a cast alloy without any work, it can have a hardness of not less than 130 Hv, and, if the composition and conditions are appropriately selected, it can have a hardness of not less than 150 Hv, which are far higher than conventional values. In the case of a worked alloy, it can have a hardness of not less than 150 Hv at a working rate of not less than 50%, and it can have a hardness of not less than 180 Hv, or further of not less than 200 Hv, depending on the case, at a working rate of not less than 90%. Note that the working rate of the alloy is set to fall in a range of preferably up to 99.0%, and more preferably up to 99.6%, though it can be set at an arbitrary value.

It has also been found for the first time that, in addition to a high hardness, the alloy can have a large Young's modulus of not less than 6,000 kg/mm$^2$. Where the process conditions are optimized, a very large modulus of not less than 7,000 kg/mm$^2$, or further at 8,000 kg/mm$^2$, depending on the case, can be obtained.

In other words, according to the present invention, it is possible to obtain an alloy member having both of a high hardness and a high Young's modulus without reference to the gold purity. Conventional, a 24K-gold alloy has a Young's modulus of about 4,000 kg/mm$^2$ at most, and a 18K-gold alloy has a Young's modulus of about 5,800 kg/mm$^2$ at most. In the present embodiment, a 18K-gold alloy can have a high Young's modulus of not less than 6,000 kg/mm$^2$, or further of not less than 7,000 kg/mm$^2$, depending on the case. Where the composition and conditions are optimized, it is possible to obtain a Young's modulus of not less than 8,000 kg/mm$^2$, which corresponds to the level of 99.99% Au that hardly contains impurities. The 99.99% Au has a low hardness of not more than 50 Hv, while it has a high Young's modulus. Accordingly, it is difficult to apply the 99.99% Au to decorative members, dental members, electronic members, etc. In contrast, an alloy member according to this embodiment has both of a high hardness and a high Young's modulus, as described above, and thus is suitable for these applications.

Such a high hardness and a high Young's modulus are also obtained in a high purity gold alloy member having a gold Au content of not less than 98.5 wt %, and particularly of not less than 99.45 wt %. Accordingly, the objective alloy members according to this embodiment also cover an alloy member constituted of a cast alloy without any work, which has a hardness of not less than 130 Hv and a Young's modulus of 5,000 kg/mm$^2$, and an alloy member constituted of a worked alloy, which has a hardness of not less than 150 Hv and a Young's modulus of 5,000 kg/mm$^2$; where each of the alloy members is constituted of a high purity gold alloy, which has a gold Au content of not less than 98.5 wt %, and contains a hardening additive in a range of not less than 50 ppm but less than 15,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B. This high purity gold alloy member of not less than 98.5 wt % is manufactured in accordance with the same conditions as those described above. Where the conditions are optimized, it is possible to obtain a Young's modulus of not less than 6,000 kg/mm$^2$, or further of not less than 7,000 kg/mm$^2$, depending on the case, and a high hardness of not less than 180 Hv, or further of not less than 200 Hv, depending on the case.

In both the cases of a gold purity of from 37.5 to 98. 45 wt %, and of not less than 98.5%, the most preferable conditions for obtaining a high hardness and a high Young's modulus include a temperature of from 600 to 1,000° C. for the solution heat treatment, and a temperature of from 150 to 500° C. for the aging treatment.

Explanations will be given of second to fifth embodiments of the present invention.

A hard precious metal alloy member according to the second embodiment of the present invention is constituted of a platinum alloy, which has a platinum Pt content of 85.0 wt %, and contains a hardening additive in a range of not less than 50 ppm but less than 15,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B.

A hard precious metal alloy member according to the third embodiment of the present invention is constituted of a silver alloy, which has a silver Ag content of not less than 80.0 wt %, and contains a hardening additive in a range of not less than 50 ppm but less than 15,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B.

A hard precious metal alloy member according to the fourth embodiment of the present invention is formed of a precious metal alloy, which is constituted of two or more elements selected from the precious metal element group consisting of gold Au, silver Ag, platinum Pt, palladium Pd, rhodium Rh, ruthenium Ru, and osmium Os, and contains a hardening additive in a range of not less than 50 ppm but less than 15,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B.

A hard precious metal alloy member according to the fifth embodiment of the present invention is formed of a precious metal alloy, which is constituted of at least one element selected from the group consisting of gold Au, silver Ag, platinum Pt, palladium Pd, rhodium Rh, ruthenium Ru, and osmium Os, and at least one element selected from the group consisting of copper Cu, nickel Ni, aluminum Al, zinc Zn, and Fe, and contains a hardening additive in a range of not less than 50 ppm but less than 15,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B.

Also in these embodiments, Ca is preferably selected from the alkaline-earth elements. Where gadolinium Gd and silicon Si are used for the hardening additive, the amount of Gd is preferably set to be not more than 50 wt % of the total amount of Gd and Si. Where gadolinium Gd and aluminum Al are used, the amount of Gd is preferably set to be not less than 10 wt % of the total amount of Gd and Al.

An alloy to which any one of the second to fifth embodiments is applied is not limited to a specific alloy, but the following alloys are mentioned for example. A platinum Pt alloy according to the second embodiment is exemplified by a Pt—Pd or Pt—Pd—Cu based alloy. A silver Ag alloy according to the third embodiment is exemplified by an Ag—Cu—Zn based alloy. A precious metal alloy according to the fourth embodiment is exemplified by an Au—Pd—Ag, Au—Pt—Pd—Ag, or Ag—Pd based alloy. A precious metal alloy according to the fifth embodiment is exemplified by an Au—Pt—Pd—Cu—Zn or Ag—Pd—Cu—Zn based alloy. Alloys according to the fourth and fifth embodiments include alloys overlapping those according to the first to third embodiments, and also include alloys in which the content of each precious metal element is lower than that according to the first to third embodiments. Components contained other than the hardening additive are also not limited, so long as they are ones generally used for precious metal alloys. In other words, the hardening additive described above is effective to any existing precious metal alloy.

An alloy member according to any one of the second to fifth embodiments is also manufactured by the same method as that of the first embodiment. Specifically, in the case of a cast alloy, an alloy material having a composition as described above is cast, then is subjected to a solution heat treatment in which it is heated to a predetermined temperature and then quickly cooled, and then is subjected to an aging treatment. In the case of a worked alloy, an alloy material having a composition as described above is cast, then is subjected to a solution heat treatment in which it is heated to a predetermined temperature and then quickly cooled, and then is worked into a predetermined shape, wherein the material is subjected to an aging treatment before or after being worked. The temperatures for the solution heat treatment and the aging treatment in these cases are the same as those of the first embodiment, i.e., the solution heat treatment may be performed at a temperature of from 600 to 2,500° C., while the aging treatment may be performed at a temperature of from 150 to 600° C. For the most preferable conditions, the temperature for the solution heat treatment falls in a range of from 500 to 1,600° C., while the temperature for the aging treatment falls in a range of from 150 to 500° C. The working rate of the alloy can be arbitrarily set, but its preferable range is the same as that of the first embodiment.

In the precious metal alloy member constituted of a platinum alloy according the second embodiment, a hardening additive, which is constituted of gadolinium Gd only, or a combination thereof with another element, is added in an appropriate amount, and then the above described treatments are performed. As a result, even in the case of a cast alloy without any work, it can have a high hardness of not less than 120 Hv, which has never been obtained. In the case of a worked alloy, it can have a hardness of not less than 150 Hv at a working rate of about 50%, and it can have a hardness of not less than 170 Hv at a working rate of not less than 90%. A platinum alloy has an inherent disadvantage in that the hardness is low, though the Young's modulus is high. Accordingly, the conventional alloy can be hardly applied to the uses that the present invention aims at, or the alloy may be applied thereto by adding an element, such as Cu etc. In the latter case, problems are entailed in the corrosion resistance and the color tone due to Cu etc., as well as an unsatisfactory hardness. In contrast, according to the present invention, the alloy can have a high hardness as described above, and also maintain a high Young's modulus of not less than 8,000 kg/mm$^2$. Where the composition and manufacturing conditions are adjusted, it is possible to obtain a very high Young's modulus of not less than 10,000 kg/mm$^2$, further of not less than 15,000 kg/mm$^2$, or still further of 20,000 kg/mm$^2$, depending on the case, while maintaining a high hardness.

Also in the alloy member according to any one of the third to fifth embodiments, a hardening additive, which is constituted of gadolinium Gd only, or a combination thereof with another element, is added in an appropriate amount, and then the above described treatments are performed. As a result, even in the case of a cast alloy, it can have a hardness of not less than 130 Hv, which is remarkably higher than conventional values. In the case of a worked alloy, it can have a hardness of not less than 150 Hv at a working rate of about 50%, and it can have a hardness of not less than 180 Hv at a working rate of not less than 90%. Furthermore, the alloy can have a high Young's modulus of not less than 7,000 kg/mm$^2$, thereby providing an alloy member having both of a high hardness and a high Young's modulus. Where the composition and manufacturing conditions are optimized, it is possible to obtain a very high Young's modulus of not less than 8,000 kg/mm$^2$, or further of not less than 10,000 kg/mm$^2$, depending on the case, as well as a very high hardness of 200 Hv.

Explanations will be given of sixth to eighth embodiments of the present invention.

A hard precious metal alloy member according to the sixth embodiment of the present invention is constituted of a high purity platinum alloy, which has a platinum Pt content of 99.45 wt %, and contains a hardening additive in a range of not less than 50 ppm but less than 5,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B.

A hard precious metal alloy member according to the seventh embodiment of the present invention is constituted of a high purity palladium alloy, which has a palladium Pd content of 99.45 wt %, and contains a hardening additive in a range of not less than 50 ppm but less than 5,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B.

A hard precious metal alloy member according to the eighth embodiment of the present invention is constituted of a high purity silver alloy, which has a silver Ag content of 99.45 wt %, and contains a hardening additive in a range of not less than 50 ppm but less than 5,000 ppm, wherein the hardening additive is constituted of gadolinium Gd only, or gadolinium Gd and at least one element selected from the group consisting of rare-earth elements other than Gd, alkaline-earth elements, silicon Si, aluminum Al, and boron B.

It has been found that, even in the case of a high purity platinum alloy, a high purity palladium alloy, and a high purity silver alloy, as in the sixth to eighth embodiments, an alloy member having both of a high hardness and a high Young's modulus is obtained where a hardening additive, which is constituted of gadolinium Gd only, or a combination thereof with another element, is added in an appropriate amount, as in the alloys according to the second to fifth embodiments.

Also in these embodiments, Ca is preferably selected from the alkaline-earth elements. Where gadolinium Gd and silicon Si are used for the hardening additive, the amount of Gd is preferably set to be not more than 50 wt % of the total amount of Gd and Si. Where gadolinium Gd and aluminum Al are used, the amount of Gd is preferably set to be not less than 10 wt % of the total amount of Gd and Al.

An alloy to which any one of the sixth to eighth embodiments is applied is not limited to a specific alloy, but may be an alloy containing a component generally used for the alloy, other than the hardening additive. Examples of the component other than the hardening additive are Cu, Ni, and Zn.

An alloy member according to any one of the sixth to eighth embodiments is also manufactured by the same method as that of the first to fifth embodiments. Specifically, in the case of a cast alloy, an alloy material having a composition as described above is cast, then is subjected to a solution heat treatment in which it is heated to a predetermined temperature and then quickly cooled, and then is subjected to an aging treatment. In the case of a worked alloy, an alloy material having a composition as described above is cast, then is subjected to a solution heat treatment in which it is heated to a predetermined temperature and then quickly cooled, and then is worked into a predetermined shape, wherein the material is subjected to an aging treatment before or after being worked. The temperatures for the solution heat treatment and the aging treatment in these cases are the same as those of the first embodiment, i.e., the solution heat treatment may be performed at a temperature of from 600 to 2,500° C., while the aging treatment may be performed at a temperature of from 150 to 600° C. For the most preferable conditions, the temperature for the solution heat treatment falls in a range of from 500 to 1,600° C., while the temperature for the aging treatment falls in a range of from 150 to 500° C. The working rate of the alloy can be arbitrarily set, but its preferable range is the same as that of the first embodiment.

In the precious metal alloy member constituted of a platinum alloy according the sixth embodiment, a hardening additive, which is constituted of gadolinium Gd only, or a combination thereof with another element, is added in an appropriate amount, and then the above described treatments are performed. As a result, as in the second embodiment, even in the case of a cast alloy without any work, it can have a high hardness of not less than 120 Hv, which has never been obtained. In the case of a worked alloy, it can have a hardness of not less than 150 Hv at a working rate of not less than 50%, and it can have a hardness of not less than 170 Hv, or further of not less than 180 Hv, depending on the case, which have never been obtained, at a working rate of not less than 90%. In addition, it is possible to obtain a high Young's modulus of not less than 8,000 kg/mm$^2$. Where the composition and manufacturing conditions are adjusted, it is possible to obtain a higher Young's modulus of not less than 10,000 kg/mm$^2$, while maintaining a high hardness. Furthermore, where the composition and manufacturing conditions are optimized, it is possible to obtain a very high Young's modulus of not less than 15,000 kg/mm$^2$, or further of 20,000 kg/mm$^2$, depending on the case.

Also in the alloy member according either one of the seventh and eighth embodiments, a hardening additive, which is constituted of gadolinium Gd only, or a combination thereof with another element, is added in an appropriate amount, and then the above described treatments are performed. As a result, even in the case of a cast alloy, it can have a hardness of not less than 120 Hv, which is remarkably higher than conventional values. In the case of a worked alloy, it can have a hardness of not less than 140 Hv at a working rate of about 50%, and it can have a hardness of not less than 150 Hv, or further of not less than 170 Hv, depending on the case, at a working rate of not less than 90%. Furthermore, the alloy can have a high Young's modulus of not less than 7,000 kg/mm$^2$. Where the composition and manufacturing conditions are optimized, it is possible to obtain a very high Young's modulus of not less than 8,000 kg/mm$^2$, or further of not less than 10,000 kg/mm$^2$, depending on the case.

Conventionally, each of a high purity platinum alloy, a high purity palladium alloy, and a high purity silver alloy has a low Vickers hardness of about 100 Hv even at a working rate of not less than 90%. Accordingly, the alloy can be hardly applied to the uses that the present invention aims at. In order to obtain a hardness satisfactory to some extent, an element, such as Cu, Zn, etc., has to be added in a range of from 5 to 10% to lower the purity, thereby sacrificing the corrosion resistance and the color tone. In contrast, according to the present invention, it is possible to obtain a precious metal alloy member having both of a high hardness and a high Young's modulus, even with a high purity.

As described above, according to the present invention, a high hardness and a high Young's modulus are obtained in various kind of precious metal alloys, where each alloy is added with a slight amount of a hardening additive, which is constituted only of gadolinium Gd, or mainly of Gd. Only a small amount of the hardening additive is required to be added to improve the mechanical properties, and Gd etc. occupy a small volume, so that the color tone is prevented from being affected. Accordingly, the alloy can have a satisfactory color tone. Furthermore, since Gd hardly influences the color tone, another element may be positively added so that a color gold having a predetermined color can be manufactured. Besides, the hardening additive is required to be added in a slight amount, as described above, a decrease in electrical properties is small, thereby obtaining satisfactory electrical properties. Since Gd is easily dispersed, an alloy according to the present invention provides a good workability and operability. While Gd is added to an alloy to increase the hardness and the Young's modulus, it does not decrease the corrosion resistance, thereby allowing the alloy to have a satisfactory corrosion resistance.

EXAMPLES

Examples of the present invention will be described below.

Using electrolytic gold having a gold purity of 99.995 wt %, gold alloys having compositions shown in Table 1 to correspond to 24K, 22K, 20K, 14K, and 9K were prepared by means of melting. In the case of a worked article, a material was continuously cast into a wire of 8 mmϕ by a continuously casting machine. After that, the continuously cast material was subjected to a solution heat treatment in which it was held at 800° C. for one hour and then quickly cooled, and then was worked by a grooved roll and a die at various working rates. The material was subjected to an aging treatment at 250% for three hours before or after being worked.

In the case of a cast article, a material was cast within the atmosphere by means of a pressurizing and rotating method, then was subjected to a solution heat treatment and an aging treatment, using the same conditions as those described above.

For the respective articles, the color tone was evaluated, and the Vickers hardness, breaking strength, and Young's modulus were measured. The corrosion resistance was also evaluated. The result of these is shown in Table 2.

Note that, in Table 1, Examples 1 to 9 fall in a range according to the present invention, while Comparative Examples 1 to 3 are conventional alloys.

TABLE 1

(wt %)

| | | Au | Pt | Pd | Ag | Cu | Zn | Gd | Ca | Si | Al | B |
|---|---|---|---|---|---|---|---|---|---|---|---|---|
| Example | 1 | 38 | 10 | — | 39 | 3 | — | 0.6 | — | — | — | — |
| | 2 | 38 | 1 | 12 | 42.6 | 6 | — | 0.3 | — | — | — | 0.03 |
| | 3 | 75 | 9 | 10 | — | 3 | 2 | 0.3 | 0.3 | — | — | — |
| | 4 | 75 | 10 | — | 14.4 | — | — | 0.3 | — | — | 0.3 | — |
| | 5 | 88 | 7 | 3.15 | — | — | 1.5 | 0.29 | — | 0.05 | — | 0.01 |
| | 6 | 88 | 7.4 | 2 | 2 | — | — | 0.3 | 0.3 | — | — | — |
| | 7 | 92 | — | 7.4 | — | — | — | 0.3 | 0.3 | — | — | — |
| | 8 | 92 | — | — | 4.4 | 3 | — | 0.25 | 0.25 | — | 0.1 | — |
| | 9 | 99.5 | — | — | — | — | — | 0.40 | — | 0.05 | 0.05 | — |
| Comparative Example | 1 | 99.8 | — | — | — | — | — | — | 0.2 | — | — | — |
| | 2 | 75 | — | — | 12.5 | 12.5 | — | — | — | — | — | — |
| | 3 | 75 | 10 | 10 | — | 3 | 2 | — | — | — | — | — |
| | 4 | 38 | 1 | 12 | 43 | 6 | — | — | — | — | — | — |
| | 5 | 92 | — | — | 5 | 3 | — | — | — | — | — | — |

TABLE 2

| No. | Alloy | | Working Rate (%) | Vickers Hardness (Hv) | Breaking Strength (kg/mm$^2$) | Young's Modulus (kg/mm$^2$) | Corrosion Resistance | Color Tone |
|---|---|---|---|---|---|---|---|---|
| 1 | Example | 1 | 0 | 152 | 68 | 8900 | Good | Good |
| 2 | | 1 | 50 | 240 | 78 | 9500 | Good | Good |
| 3 | | 1 | 90 | 270 | 89 | 9700 | Good | Good |
| 4 | | 2 | 0 | 190 | 70 | 8500 | Good | Good |
| 5 | | 2 | 50 | 280 | 76 | 9200 | Good | Good |
| 6 | | 2 | 90 | 310 | 87 | 9500 | Good | Good |
| 7 | | 3 | 0 | 161 | 72 | 8200 | Good | Good |
| 8 | | 3 | 50 | 193 | 85 | 9800 | Good | Good |
| 9 | | 3 | 90 | 230 | 89 | 9900 | Good | Good |
| 10 | Comparative Example | 3 | 0 | 120 | 68 | 4900 | Good | Good |
| 11 | | 3 | 50 | 150 | 73 | 5400 | Good | Good |

TABLE 2-continued

| No. | Alloy | | Working Rate (%) | Vickers Hardness (Hv) | Breaking Strength (kg/mm$^2$) | Young's Modulus (kg/mm$^2$) | Corrosion Resistance | Color Tone |
|---|---|---|---|---|---|---|---|---|
| 12 | | 3 | 90 | 180 | 76 | 5800 | Good | Good |
| 13 | Example | 4 | 90 | 270 | 84 | 8600 | Good | Good |
| 14 | | 5 | 90 | 245 | 87 | 8500 | Good | Good |
| 15 | | 6 | 90 | 250 | 88 | 8900 | Good | Good |
| 16 | | 7 | 90 | 220 | 89 | 9200 | Good | Good |
| 17 | | 8 | 90 | 210 | 87 | 9500 | Good | Good |
| 18 | | 9 | 0 | 135 | 75 | 8500 | Good | Good |
| 19 | | 9 | 90 | 183 | 89 | 8600 | Good | Good |
| 20 | Comparative Example | 1 | 90 | 135 | 48 | 4800 | Corroded | Color-changed |
| 21 | | 2 | 90 | 225 | 77 | 5800 | Good | Good |
| 22 | | 4 | 90 | 260 | 60 | 5700 | Good | Good |
| 23 | | 5 | 90 | 160 | 68 | 5400 | Good | Good |

Figure 2:
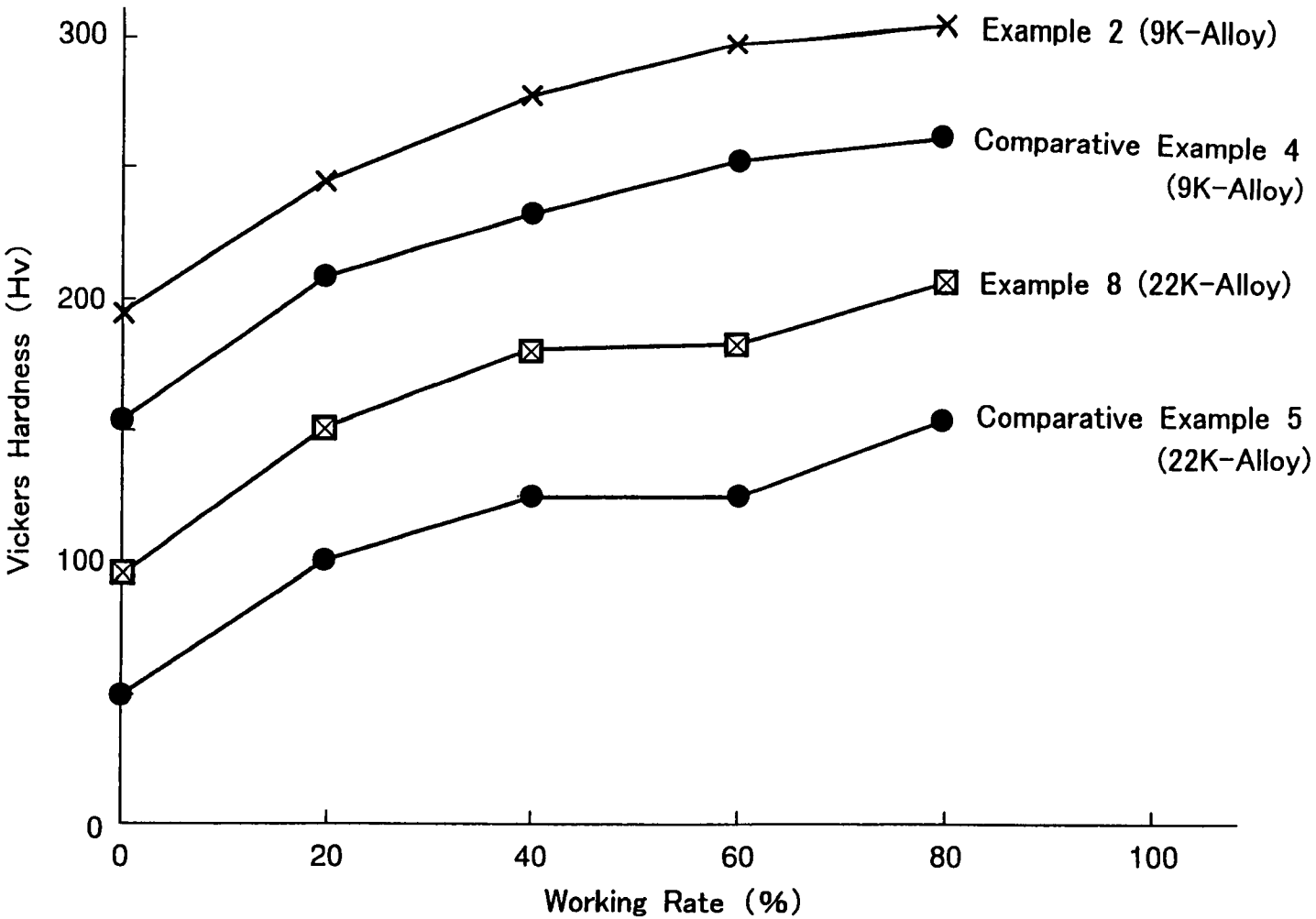
FIG. 2 is a view showing relationships between the working rate and the hardness in gold alloys corresponding to 9K-gold to 22K-gold.

As shown in Table 2, as for Examples 1 to 3, even the cast articles exhibited a hardness of not less than 150 Hv, and the worked articles exhibited a higher hardness, such that their hardness was higher than that of Comparative Examples 1 to 3, i.e., conventional articles. At working rate of 90%, the hardness was not less than 180 Hv, or not less than 200 Hv, depending on the case. FIG. 1 is a view showing relationships between the working rate and the hardness in gold alloys corresponding to 18K-gold. FIG. 2 is a view showing relationships between the working rate and the hardness in gold alloys of different gold contents.

As for Examples 1 to 9, the Young's modulus was not less than 8,000 kg/mm$^2$, which was higher than that of Comparative Examples 1 to 3, i.e., conventional articles. As for Examples 1 to 3 according to the present invention, it was confirmed that the Young's modulus did not decrease even where the hardness increased.

Even where the amount of a hardening additive was as small as not more than 0.45 wt %, necessary hardness and Young's modulus were obtained. Furthermore, even where each alloy was worked up to a working rate of 99.6% without annealing, no problems arose, whereby it was confirmed that the alloy had a satisfactory workability.

As for Examples 1 to 9, the breaking strength and the corrosion resistance were satisfactory, such that the hardness was hardly lowered by brazing.

As for Example 9 using a high purity gold alloy having a gold content of not less than 98.5 wt %, it was confirmed that the cast alloy could have a high hardness of not less than 130 Hv, and the worked alloy at working rate of not less than 90% could have a high hardness of not less than 150 Hv and a high Young's modulus of not less than 8,000 kg/mm$^2$. The color tone was also satisfactory.

Furthermore, selecting additive elements, 21K- and 22K-color gold alloys of yellow, red, pink, white, gray, blue, green, and purple were prepared. As a result, it was confirmed that desired color tones were obtained.

Next, using precious metals each having a purity of 99.995 wt %, precious metal alloys having compositions shown in Table 3 were prepared by means of melting. In the case of a worked article, as in the above described Examples, a material was continuously cast into a wire of 8 mmϕ by a continuously casting machine. After that, the continuously cast material was subjected to a solution heat treatment in which it was held at 800° C. for one hour and then quickly cooled, and then was worked by a grooved roll and a die at various working rates. The material was subjected to an aging treatment at 250° C. for three hours before or after being worked.

In the case of a cast article, a material was cast within the atmosphere by means of a pressurizing and rotating method, then was subjected to a solution heat treatment and an aging treatment, using the same conditions as those described above.

For the respective articles, the color tone was evaluated, and the Vickers hardness, breaking strength, and Young's modulus were measured. The corrosion resistance was also evaluated. The result of these is shown in Table 4.

Note that, in Table 3, Examples 11 to 21 fall in a range according to the present invention, while Comparative Examples 11 to 13 are conventional alloys.

TABLE 3

| | | Au | Pt | Pd | Ag | Cu | Zn | Gd | Ca | Si | Al | B | (wt %) Other |
|---|---|---|---|---|---|---|---|---|---|---|---|---|---|
| Example | 11 | 92.0 | 5.5 | — | — | 2.0 | — | 0.40 | — | 0.05 | — | — | 0.05 |
| | 12 | 75.0 | 8.0 | 12.0 | — | 2.8 | 1.8 | 0.25 | 0.25 | — | — | — | 0.10 |
| | 13 | 75.0 | — | 13.0 | 4.0 | 2.0 | 2.0 | 0.30 | — | — | — | 0.01 | — |
| | 14 | 50.0 | 5.0 | 5.0 | 39.0 | — | — | 0.50 | — | — | 0.50 | — | — |
| | 15 | — | 90.0 | 9.66 | — | — | — | 0.25 | — | 0.04 | — | — | 0.05 |
| | 16 | — | 85.0 | 17.4 | — | 2.0 | — | 0.25 | 0.25 | — | 0.10 | — | — |
| | 17 | — | — | 99.85 | — | — | — | 0.12 | — | 0.02 | — | — | 0.01 |
| | 18 | — | — | — | 99.85 | — | — | 0.08 | 0.06 | — | — | — | 0.01 |
| | 19 | — | — | — | 92.5 | 3.0 | 3.7 | 0.28 | — | 0.02 | — | — | 0.02 |
| | 20 | — | 99.85 | — | — | — | — | 0.70 | 0.07 | — | — | — | 0.01 |
| | 21 | — | — | 7.0 | 77.0 | 5.85 | 10.0 | 0.07 | 0.07 | — | — | 0.01 | — |
| Comparative Example | 11 | 75.0 | 18.0 | 12.0 | — | 3.0 | 2.0 | — | — | — | — | — | — |
| | 12 | — | 90.0 | 5.0 | — | 5.0 | — | — | — | — | — | — | — |
| | 13 | — | — | — | 92.5 | 3.29 | 3.75 | — | — | 0.20 | — | 0.01 | — |

TABLE 3-continued

| | Au | Pt | Pd | Ag | Cu | Zn | Gd | Ca | Si | Al | B | (wt %) Other |
|---|---|---|---|---|---|---|---|---|---|---|---|---|
| 14 | — | — | 7.0 | 77.0 | 6.0 | 10.0 | — | — | — | — | — | — |
| 15 | — | — | 99.9 | — | — | — | — | — | — | — | — | 0.1 |
| 16 | — | — | — | 99.9 | — | — | — | — | — | — | — | 0.1 |

TABLE 4

| No. | Alloy | | Working Rate (%) | Vickers Hardness (Hv) | Breaking Strength ($kg/mm^2$) | Young's Modulus ($kg/mm^2$) | Corrosion Resistance | Color Tone |
|---|---|---|---|---|---|---|---|---|
| 24 | Example | 11 | 0 | 153 | 79 | 7500 | Good | Good |
| 25 | | 11 | 50 | 190 | 87 | 8800 | Good | Good |
| 26 | | 11 | 90 | 230 | 89 | 9500 | Good | Good |
| 27 | | 12 | 0 | 170 | 92 | 8100 | Good | Good |
| 28 | | 12 | 50 | 210 | 110 | 9000 | Good | Good |
| 29 | | 12 | 90 | 245 | 115 | 9400 | Good | Good |
| 30 | | 13 | 0 | 160 | 90 | 8500 | Good | Good |
| 31 | | 13 | 50 | 205 | 115 | 9500 | Good | Good |
| 32 | | 13 | 90 | 250 | 120 | 10600 | Good | Good |
| 33 | | 14 | 90 | 195 | 67 | 18000 | Good | Good |
| 34 | | 15 | 0 | 125 | 41 | 18000 | Good | Good |
| 35 | | 15 | 50 | 172 | 64 | 19200 | Good | Good |
| 36 | | 15 | 90 | 198 | 71 | 19300 | Good | Good |
| 37 | | 16 | 90 | 203 | 78 | 21000 | Good | Good |
| 38 | | 17 | 90 | 166 | 61 | 12000 | Good | Good |
| 39 | | 18 | 90 | 156 | 56 | 9800 | Good | Good |
| 40 | | 19 | 90 | 215 | 84 | 10200 | Good | Good |
| 41 | | 20 | 90 | 180 | 70 | 18200 | Good | Good |
| 42 | | 21 | 90 | 170 | 72 | 9700 | Good | Good |
| 43 | Comparative Example | 11 | 0 | 130 | 67 | 5400 | Good | Good |
| 44 | | 11 | 50 | 155 | 69 | 5600 | Good | Good |
| 45 | | 11 | 90 | 183 | 73 | 5900 | Good | Good |
| 46 | | 12 | 90 | 125 | 18 | 14800 | Good | Good |
| 47 | | 13 | 90 | 172 | 38 | 6900 | Good | Good |
| 48 | | 14 | 90 | 90 | 35 | 6500 | — | — |
| 49 | | 15 | 90 | 120 | 28 | 11530 | — | — |
| 50 | | 16 | 90 | 95 | 31 | 8440 | — | — |

Figure 3:
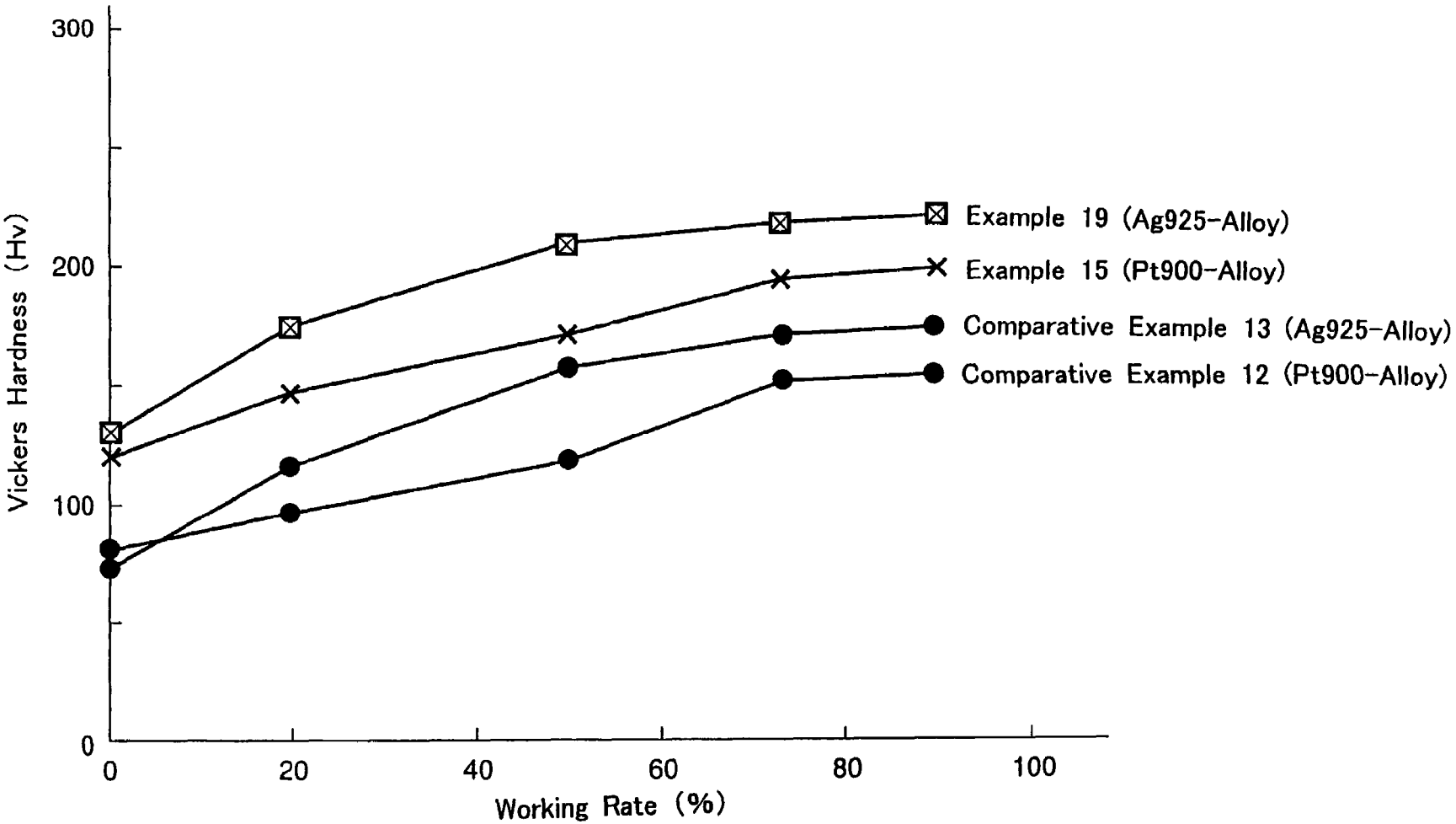
FIG. 3 is a view showing relationships between the working rate and the hardness in alloys based on precious metals other than gold.

As shown in Table 4, as for Examples 11 to 21, i.e., precious metal alloys falling in a range according to the present invention, although depending on compositions, the hardness and the Young's modulus were high, the corrosion resistance and the color tone were excellent, such that the properties were better than those of alloys corresponding to respective grades. Particularly, an alloy member of a platinum alloy could have a high hardness, while maintaining a high Young's modulus of platinum, such as a high value of not less than 10,000 $kg/mm^2$, or further of not less than 20,000 $kg/mm^2$, depending on compositions. Furthermore, as shown in FIG. 3, at a high working rate, there were cases where the Vickers hardness was more than 200 Hv.

A hard precious metal member according to the present invention has a high hardness and a satisfactory corrosion resistance, and thus has an excellent durability. The member also has a high Young's modulus to exhibit a spring characteristic, and thus is not brittle while having a high hardness. Accordingly, the member has excellent mechanical properties, and thus can be made light and thin. The member also has a satisfactory color tone. In addition, the member has a good workability and operability.

Since the hard precious metal member according to the present invention has the above described properties, it is suitable for jewels and ornaments, such as a necklace, a bracelet, a pendant, an earring, etc. Furthermore, the member has a high hardness, and a spring characteristic due to a high Young's modulus, it is suitable for fibers and daily-use-articles, such as a watch band, an eyeglass frame, a clasp, etc. Where the member is applied to a musical instrument, a bell, etc., utilizing these properties of a high hardness and a high Young's modulus, a good sound can be obtained. The member is suitable further of an electronic member, such as a bonding wire, a lead frame, a connector, etc., a cladding member, a spark plug member of automobiles, a dental member, etc.

What is claimed:

1. A method of manufacturing a hard precious metal alloy member comprising the steps of:

(a) casting a material consisting essentially of a silver alloy, which has a silver content of not less than 80.0 wt %, and contains gadolinium in an amount of not less than 50 ppm, but less than 15,000 ppm in total;

(b) subjecting the material to a solution heat treatment; and (c) subjecting the material to an aging treatment after the solution heat treatment.

2. The method of manufacturing a hard precious metal alloy member according to claim 1, which further comprises, after step (b) and before step (c), working the material into a predetermined shape.

3. The method of manufacturing a hard precious metal alloy member according to claim 1, wherein the material contains gadolinium and at least one element selected from the group consisting of a rare-earth element other than gadolinium, an alkaline-earth element, silicon, aluminum, and boron, in an amount of not less than 50 ppm, but less than 15,000 ppm in total.

4. The method of manufacturing a hard precious metal alloy member according to claim 3, which further comprises, after step (b) and before step (c), working the material into a predetermined shape.

5. The method of manufacturing a hard precious metal alloy member according to claim 1, wherein the solution heat treatment is carried out at a temperature of 600 to 2500° C. and the aging treatment is carried out at a temperature of 150 to 600° C.

6. A method of manufacturing a hard precious metal alloy member comprising the steps of:

(a) casting a material consisting essentially of a silver alloy, which has a silver content of not less than 99.45 wt %, and contains gadolinium, and optionally at least one element selected from the group consisting of a rare-earth element other than gadolinium, an alkaline-earth element, silicon, aluminum and boron, in an amount of not less than 50 ppm, but less than 5,000 ppm in total;

(b) subjecting the material to a solution heat treatment; and (c) subjecting the material to an aging treatment after the solution heat treatment.

7. The method of manufacturing a hard precious metal alloy member according to claim 6, which further comprises, after step (b) and before step (c), working the material into a predetermined shape.

8. The method of manufacturing a hard precious metal alloy member according to claim 6, wherein the material contains gadolinium and at least one element selected from the group consisting of a rare-earth element other than gadolinium, an alkaline-earth element, silicon, aluminum, and boron, in an amount of not less than 50 ppm, but less than 5,000 ppm in total.

9. The method of manufacturing a hard precious metal alloy member according to claim 8, which further comprises, after step (b) and before step (c), working the material into a predetermined shape.

10. The method of manufacturing a hard precious metal alloy member according to claim 6, wherein the solution heat treatment is carried out at a temperature of 600 to 2500° C. and the aging treatment is carried out at a temperature of 150 to 600° C.

* * * * *